United States Patent [19]

Eguchi et al.

[11] 4,152,532

[45] May 1, 1979

[54] MEANS AND METHOD OF HEATING

[75] Inventors: Isamu Eguchi, Nagoya; Susumu Hiratake, Kasugai, both of Japan

[73] Assignee: Daidotokushuko Kabushikikaisha, Aichi, Japan

[21] Appl. No.: 865,151

[22] Filed: Dec. 28, 1977

[30] Foreign Application Priority Data

Dec. 29, 1976 [JP] Japan ..... 51-160551

[51] Int. Cl.[2] ..... H05H 1/26

[52] U.S. Cl. ..... 13/2 P

[58] Field of Search ..... 13/1, 2, 2 P, 9, 10, 13/11, 33, 34; 219/121 P

[56] References Cited

U.S. PATENT DOCUMENTS

| | | | |
|---|---|---|---|
| 2,448,886 | 9/1948 | Hopkins | 13/9 ES |
| 3,373,240 | 3/1968 | Boeckler et al. | 13/34 |
| 3,380,904 | 4/1968 | Goldberger | 13/9 X |
| 3,723,630 | 3/1973 | Paton et al. | 13/1 |
| 3,813,469 | 5/1974 | Eguchi et al. | 13/9 |
| 3,940,551 | 2/1976 | Ling et al. | 13/9 R |

*Primary Examiner*—R. N. Envall, Jr.

*Attorney, Agent, or Firm*—William Anthony Drucker

[57] ABSTRACT

A feeding electrode of a heating means is a hollow cylinder with an open lower end, and is mounted on a frame. An arc-generating electrode is also mounted on the frame, and is disposed inside the feeding electrode. The lower end of the feeding electrode is immersed in a molten metal pool contained in a ladle. An electric arc struck between the arc-generating electrode and the molten metal pool inside the feeding electrode heats the molten metal pool.

8 Claims, 7 Drawing Figures

MEANS AND METHOD OF HEATING

BACKGROUND OF THE INVENTION

This invention relates to a means to heat a molten metal pool which is taken out temporarily from a furnace into a ladle before being poured into a casting mold, and to a method of heating the molten metal pool with the heating means.

When a molten metal pool taken out temporarily from a convertor into a ladle and retained there is sent then, for example, to a continuous casting apparatus for the purpose of casting, the temperature of the molten metal pool tends to fall if it is retained in the ladle for a long time. The temperature fall is serious for casting technique whatever its amount may be. Thus, an approach to overcome this problem is called for.

The inventor of the present invention has tried to heat a molten metal pool with a flame of an oil burner blown towards the surface of the pool in order to settle this problem, i.e. to prevent the temperature of the pool in the ladle from falling. However, according to this method, it is a disadvantage in practice that most of the volume of the flame moves upwards without touching the surface of the molten metal pool, and heating efficiency at the surface of the pool is very low. The flame in this trial can be substituted by a plasma torch. The heating efficiency with a plasma torch as an alternative to the oil burner remains still low unless heat of the plasma torch is confined by a special construction enclosing it.

One object of the present invention is to provide a heating means which can heat a molten metal pool while it is retained in an usual ladle, and is very simple for treating a molten metal pool.

Another object of the present invention is to provide a heating means in which a molten metal pool contained in a large ladle can be heated conveniently by plural heating units immersed in the ladle and arranged closely to one another without causing mutual interference.

Still another object of the present invention is to provide a heating means in which a heating electric arc struck in a space surrounded by a hollow feeding electrode and the surface of the pool can transmit its heat to the molten metal pool with high thermal efficiency, i.e. with reduced heat loss.

Still another object of the present invention is to provide an effective heating method according to which the surface of the molten metal pool inside the hollow feeding electrode partly immersed in the pool is depressed lower than that outside the electrode by the pressure inside the electrode raised by the gas introduced there, and the elongated arc can transmit its heat with high efficiency to the whole pool through the enlarged internal side surface of the feeding electrode.

Figure 1:
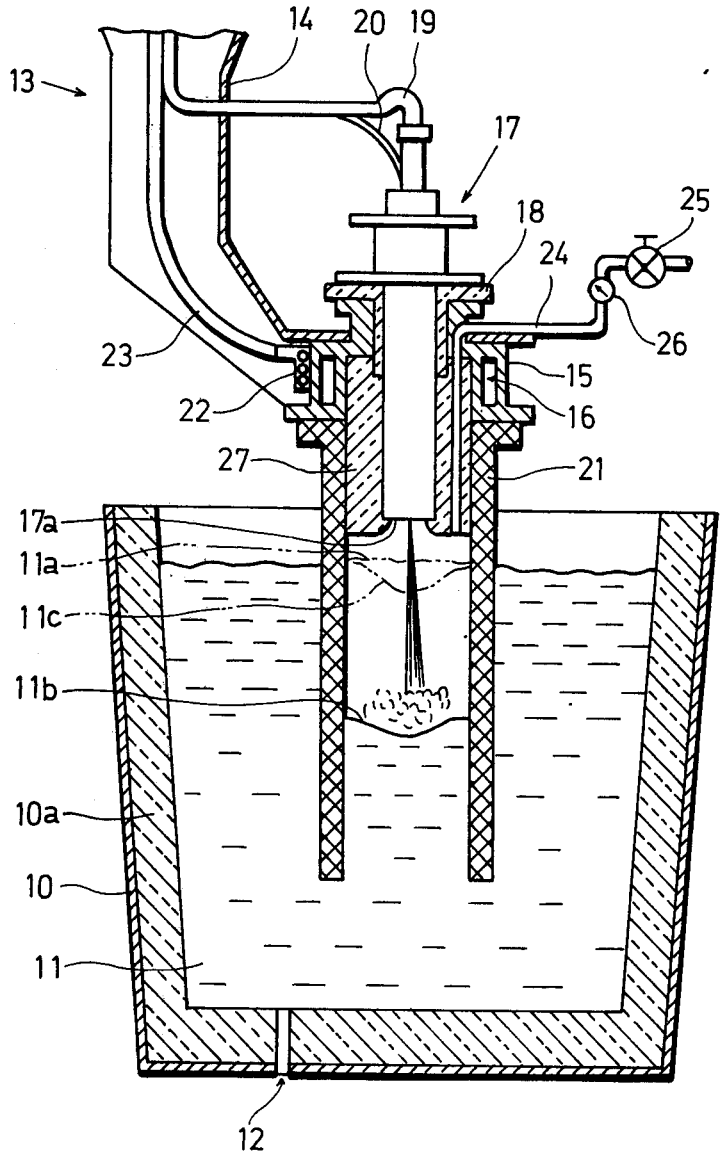
FIG. 1 is a longitudinal section showing the relationship between a ladle and a heating means.

An embodiment of the present invention is explained with reference to FIG. 1. A ladle 10 has an inner lining 10*a* made of refractory material. As is well known, the ladle 10 can contain a molten metal pool 11 brought from a converter or other kind of furnace. The molten metal of the pool 11 flows out through an outlet 12 to a continuous casting apparatus. Next, a heating means 13 is described. A holding means 14 is constructed for vertical and transverse movement according to usual art. A water-cooled holder 15 is connected to the lower end of the holding means 14, and the holder 15 is illustrated as a frame of the heating means. The holder 15 is cooled by the water introduced into an internal water channel 16 as is well known. A plasma torch 17, used as an arc-generating electrode, is mounted on an insulating asbestos flange 18 fixed on the water-cooled holder 15. The plasma torch 17 is one of the transfer type having high thermal efficiency. A negative electrode feeding cable 19 connects the plasma torch with the negative terminal of a power supply not shown. A gas feeding pipe 20 is communicated with the plasma torch 17 and feeds it with argon gas. A feeding electrode 21 in the form of a hollow circular cylinder is attached to the water-cooled holder 15, and is made of a material suitable for electrical contact with the molten metal pool 11. Graphite having superior electrical and thermal conductivity is preferable as this material. The electrode 21 may be of the form of an arbitrary cylinder other than circular one. Numeral 22 shows a terminal attached to the water-cooled holder 15, and numeral 23 shows a positive electrode feeding cable connected to the terminal 22. They establish the electrical connection between the feeding electrode 21 and the positive terminal of the power supply not shown. One end of a gas conduit 24 opens in the hollow of the feeding electrode 21, and leads the gas inside the feeding electrode 21 outwards. Numeral 25 shows a pressure regulating valve interposed in the gas conduit 24, and numeral 26 a pressure indicator. A fireproof body 27 is inserted between the water-cooled holder 15 and the plasma torch 17, and between the latter and the feeding electrode 21.

Next, the procedure in operating the above mentioned embodiment is described. First, the feeding electrode 21 of the heating means 13 is immersed into the molten metal pool 11. The immersed depth of the electrode 21 is such that the lower end 17*a* of the plasma torch 17 is brought to a height of about 50 mm above the surface 11*a* of the molten metal inside the electrode 21. Next, the hollow of the feeding electrode 21 is kept communicated with the atmosphere, and the voltage of the power supply is applied between the plasma torch 17 and the confronting surface 11*a* of the molten metal pool 11 through the cables 19, 23, the terminal 22 and the feeding electrode 21. Then, a plasma is initiated in a well known way such as superposing a high frequency voltage. The argon gas fed through the gas feeding pipe 20 is changed by the plasma torch 17 into ionized gas at high temperature. This ionized gas jets from the plasma torch 17, raises the pressure inside the feeding electrode 21 to 2~3 atms., and lowers the surface of the molten metal pool inside the feeding electrode 21. The output of the plasma torch 17 is adjusted in order to maintain the plasma as a long flame plasma (600~800 mm or more in length). In the situation thus set up, the surface of the molten metal pool inside the feeding electrode 21 is held at a lowered level shown by numeral 11*b*, and the heat of the plasma-arc ejected from the plasma torch 17 is transmitted to the molten pool 11 in the ladle 10 directly or by way of the side wall of the feeding electrode 21. The surface of the molten metal pool inside the hollow feeding electrode 21 is maintained at such a level by adjusting the pressure regulating valve 25 so as to release part of the gas inside the feeding electrode to the atmosphere. The surface of the molten metal pool inside the feeding electrode 21 can be adjusted to be brought to various levels such as lower one indicated by numeral 11*b* and higher one indicated by numeral 11*c* in accordance with various requirements. When the outflow of molten metal proceeds through the outlet 12, and the total quantity of molten metal decreases, the whole of the heating means 13 is caused to descend by lowering the holding means 14.

Figure 2:
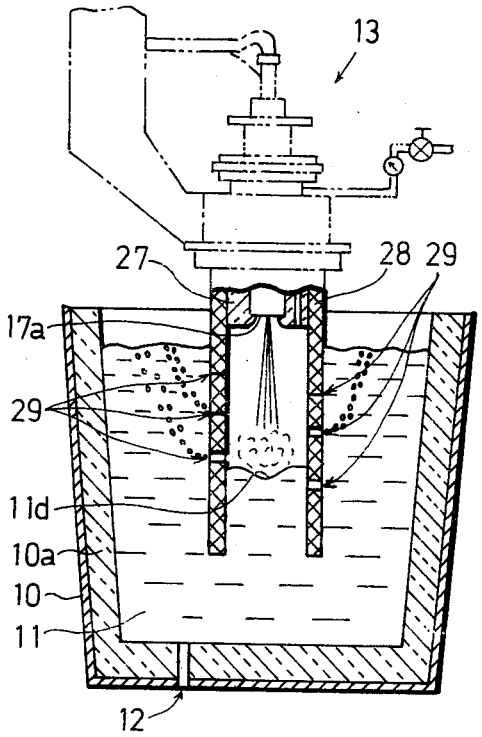
FIG. 2 is a longitudinal section showing a heating means with a feeding electrode of different construction and showing a heating process utilizing the means.
Figure 3:
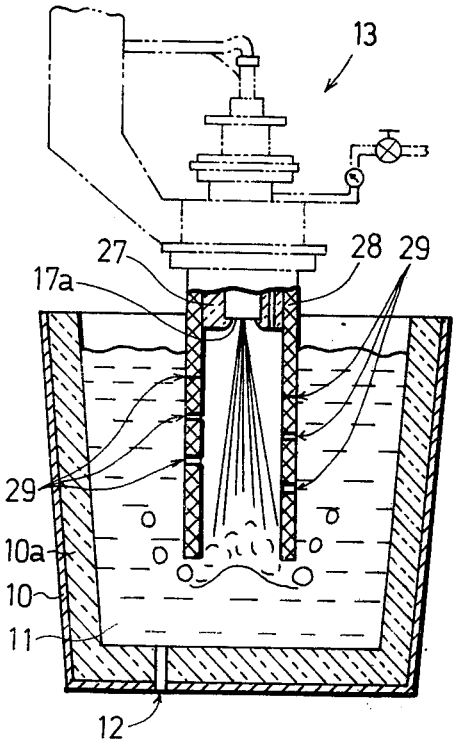
FIG. 3 is similar to FIG. 2 but with part of the heating means omitted.

FIGS. 2 and 3 show a modification of the feeding electrode construction of the heating means shown in FIG. 1. A feeding electrode 28 is made of graphite as in the case mentioned above, and is provided with many gas outflow holes 29 in its side wall.

With this version, the gas in the hollow of the feeding electrode 28 is ejected into the molten metal pool 11 through the gas outflow holes 29, giving rise to bubbling while heating is effectuated by the plasma-arc bursting out from the plasma torch 17. This bubbling by argon gas is known as the Gazal process. The level 11*d* of the molten metal pool inside the feeding electrode 28 at this phase of heating can be raised or lowered arbitrarily during operation, and can be adjusted to be lowered to the lower opening of the feeding electrode 28, permitting the gas to jet out through the lower opening. When the heating of the molten metal pool is accompanied by this bubbling, the temperature distribution can be homogenized because the molten metal pool is stirred by voids spirting upwards into the pool. When the pressure inside the feeding electrode 28 rises because of misadjustment of pressure, only the bubbling becomes violent, but danger to the heating means is small.

Figure 4:
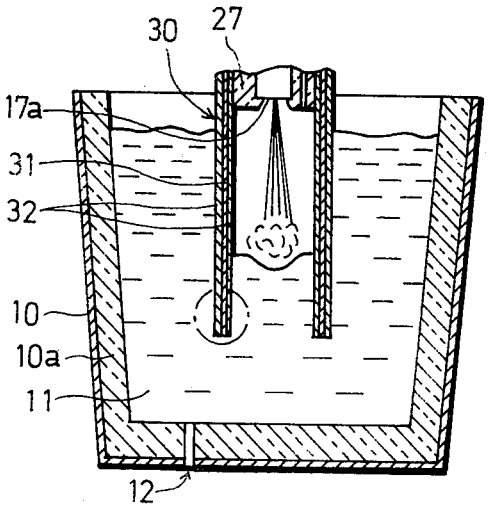
FIG. 4 is a longitudinal section showing another version of the feeding electrode.
Figure 5:
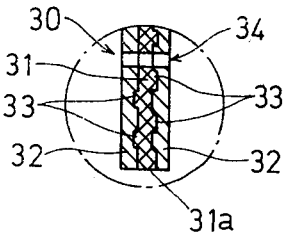
FIG. 5 is an enlarged partial view of FIG. 4.

Next, FIGS. 4 and 5 show another version of the feeding electrode in the heating means described above. A feeding electrode 30 consists of a core member 31 made of graphite for example, and refractory linings like ceramics 32 provided on the inside and the outside of the core member 31. Projections 33 extend from the core member 31, preventing the linings 32 from slipping out of the core member 31. Numeral 34 shows gas outflow holes similar to those described above. The feeding electrode 30 of such construction is utilized when elimination of carbonization of the molten metal pool by graphite is required. In this case, electrical conduction from the feeding electrode 30 to the molten metal pool 11 occurs at such small part 31*a* of the core member 31 as exposed at the lower end of the feeding electrode 30.

Figure 6:
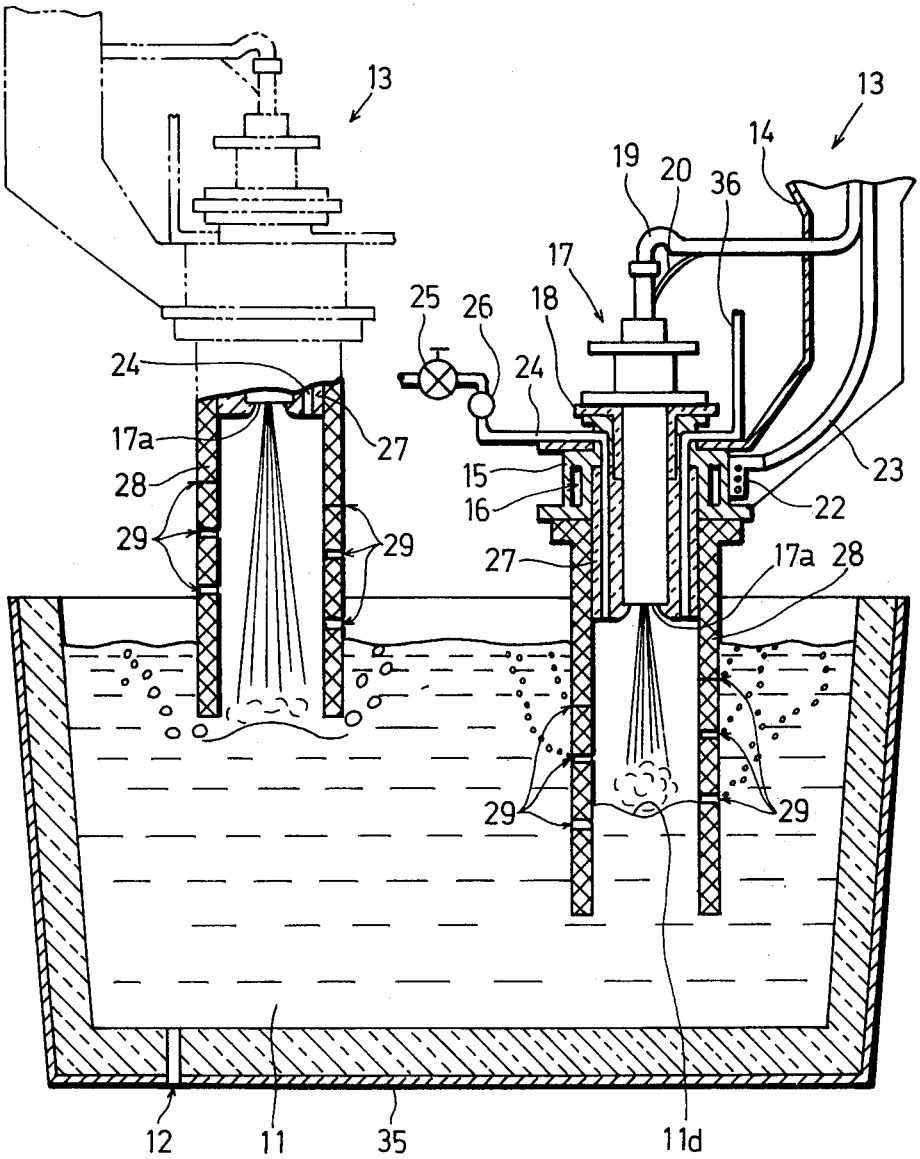
FIG. 6 is a longitudinal section showing a heating means operated with plural heating units.

Next, FIG. 6 shows a different embodiment in which the molten metal pool 11 contained in a larger ladle 35 is heated by plural heating means 13. In this embodiment, two heating means 13 and 13 are held at different heights as shown so that each of the feeding electrodes 28 can be immersed in the molten metal pool 11 at different both. Thus, the temperature of the molten metal pool can be homogenized. Of course, the immersion depth of either of the feeding electrodes 28 in this arrangement can be adjusted independently. The number of the heating means used in this way can be arbitrarily large in accordance with the volume of the ladle 35. The plasma-arcs of the plural heating means 13 are shielded by the hollow cylindrical feeding electrodes 28 from one another, and so even the electromagnetic interaction among the plasma-arcs do not make them unstable. The heating means 13 at the right hand side in this FIG. 6 has an oxygen feeding pipe 36. Thus, oxygen sent by the oxygen feeding pipe 36 to the inside of the feeding electrode 28 and the argon gas bubble together. Subsequently, also an effect equivalent to A O D, i.e. the decarbonization by argon and oxygen can be expected. Although this decarbonization can be done by oxygen alone, mixing with high temperature argon makes bubbling more violent, resulting in carbonization being more effective.

Furthermore, inert argon gas is used in this heating means 13 as a heating fluid in order to eliminate its chemical effect on the molten metal pool 11. However, it is also possible to treat the molten metal pool (molten steel) by nitrogenizing if nitrogen is used as the heating fluid.

Figure 7:
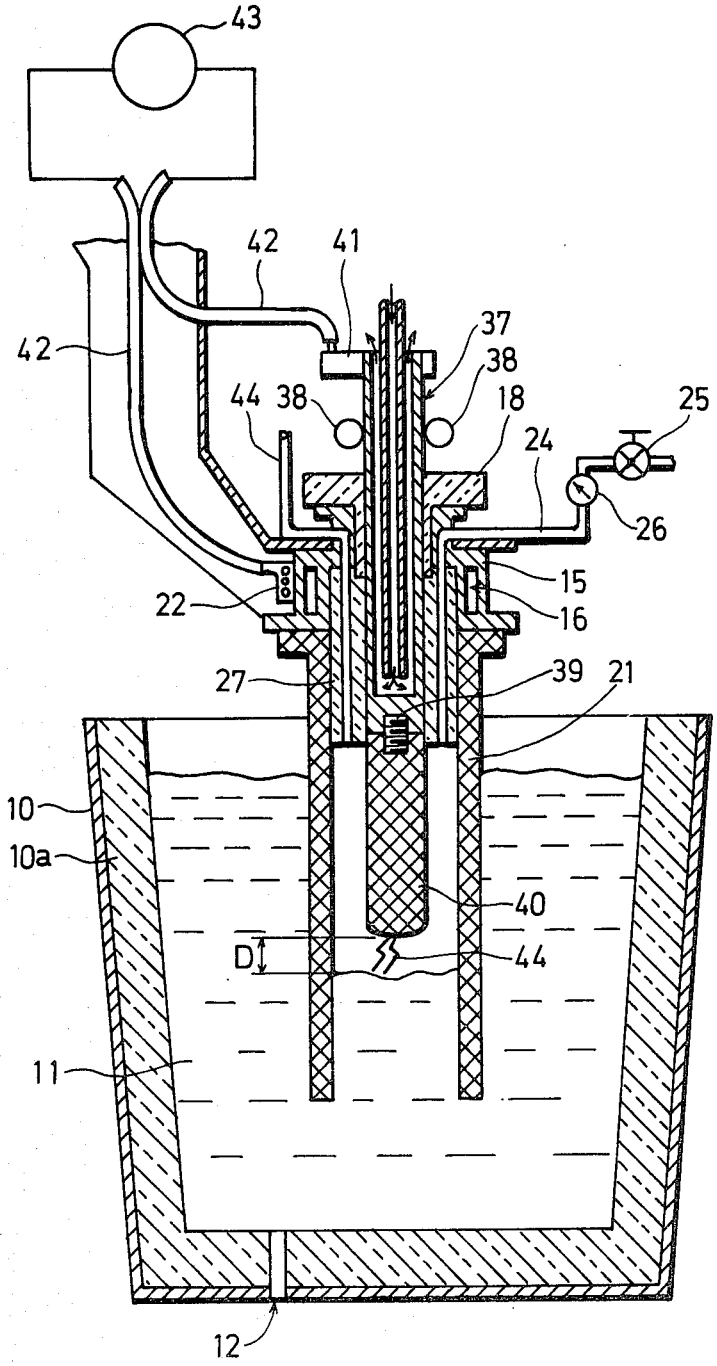
FIG. 7 is a longitudinal section showing a heating means with a graphite electrode and showing the relationship between the means and the molten metal pool.

Next, FIG. 7 shows still another embodiment in which a graphite electrode is utilized as the arc-generating electrode in FIG. 1. In this figure, a water-cooled feeding rod electrode 37 is cooled by cooling water flowing in the direction shown by an arrow. The feeding rod electrode 37 is supported by elevating rollers 38 so that the electrode 37 can move vertically against the insulating asbestos flange 18 and the water-cooled holder 15. A graphite electrode 40 is connected to the lower end of the feeding rod electrode 37 by a nipple 39. Numeral 41 shows a terminal attached to the water-cooled rod electrode 37, numeral 42 a feeder cable, and numeral 43 a power supply. A gas feeding pipe 44 supply the hollow of the cylindrical feeding electrode 21 with argon gas or other arbitrary one.

In the embodiment constructed as mentioned above, the voltage of the power supply 43 is applied between the graphite electrode 40 and the confronting molten metal pool 11, and an electric arc struck between them heats the molten metal pool 11 in the same way as in the previous case. When the molten metal pool 11 is heated in this way, the distance D between the graphite electrode 40 and the confronting molten metal pool 11 can be changed by adjusting the pressure regulating valve 25 to displace the level of the molten metal pool 11, or by moving the graphite electrode 40 vertically with the elavating rollers 38.

What I claim is:

1. A heating means including a frame, an arc-generating electrode mounted on said frame for striking an electric arc between said electrode and a molten metal pool, a hollow cylindrical feeding electrode mounted on said frame so as to enclose said electric arc, the open lower end of said feeding electrode being immersed in said pool, and a gas feeding means attached to said frame for introducing gas into the interior of said feeding electrode.

2. A heating means as described in claim 1 in which a pressure regulating means for adjusting the pressure of gas introduced into the interior of said feeding electrode is mounted on said frame.

3. A heating means as described in claim 1 in which said feeding electrode is provided with gas spirting holes bored through the wall of said feeding electrode.

4. A heating means as described in claim 1 in which said feeding electrode consists of a cylindrical core member made of graphite and of refractory linings attached on inner and outer surfaces of said core member.

5. A heating means as described in claim 1 in which said arc-generating electrode is a plasma torch.

6. A heating means as described in claim 1 in which said arc-generating electrode is made of graphite.

7. The method of heating a molten metal pool using a heating means comprising a frame, an arc-generating electrode mounted on said frame so as to strike an electric arc between said electrode and said molten metal pool, a hollow cylindrical feeding electrode mounted on said frame, said feeding electrode enclosing said electric arc, and a means for supplying gas to the interior of said feeding electrode, said method including immersing said feeding electrode in said pool, striking said electric arc between said arc-generating electrode and said pool, causing said gas introduced through said gas supplying means into the interior of said hollow cylindrical feeding electrode to depress the surface of said pool inside said feeding electrode lower than that outside, and transmitting the heat of said electric arc to said pool directly or through the side wall of said hollow cylindrical feeding electrode.

8. The method of heating a molten metal pool using a heating means comprising a frame, an arc-generating electrode mounted on said frame so as to strike an electric arc between said electrode and the molten metal pool, a hollow cylindrical feeding electrode mounted on said frame, said feeding electrode enclosing said electric arc and being provided with gas outflow holes bored through its side wall, and a means for supplying gas to the interior of said feeding electrode, said method including immersing said feeding electrode in said pool, striking said electric arc between said arc-generating electrode and said pool, causing said gas introduced through said gas supplying means into the interior of said hollow cylindrical feeding electrode to depress the surface of said pool inside said feeding electrode lower than that outside, transmitting the heat of said electric arc to said pool directly or through the side wall of said hollow cylindrical feeding electrode, releasing part of said gas through said gas outflow holes or through the open lower end of said hollow cylindrical feeding electrode into the molten metal pool outside said feeding electrode.

* * * * *